US005616351A

United States Patent [19]

Wensauer

[11] Patent Number: 5,616,351

[45] Date of Patent: Apr. 1, 1997

[54] COMPACTION HEAD OF A PRODUCTION MACHINE FOR REINFORCED CONCRETE PIPES

[75] Inventor: Gerhard Wensauer, Aschaffenburg, Germany

[73] Assignee: Wensauer Betonwerk GmbH, Stockstadt, Germany

[21] Appl. No.: 582,659

[22] Filed: Jan. 3, 1996

Related U.S. Application Data

[63] Continuation of Ser. No. 454,633, May 31, 1995, abandoned.

[30] Foreign Application Priority Data

Jun. 30, 1994 [DE] Germany ..... 44 22 891.0

[51] Int. Cl.[6] ..... B28B 21/12; B28B 21/24

[52] U.S. Cl. ..... 425/262; 425/427; 425/456; 425/457; 425/469; 264/312

[58] Field of Search ..... 425/577, 424, 425/426, 427, 428, 262, 456, 457, 469; 249/142; 264/312

[56] References Cited

U.S. PATENT DOCUMENTS

| | | | |
|---|---|---|---|
| 921,142 | 5/1909 | Myers et al. . | |
| 4,336,013 | 6/1982 | Hand | 425/262 |
| 4,340,553 | 7/1982 | Fosse | 425/262 |
| 4,540,539 | 9/1985 | Crawford et al. | 425/427 |
| 4,690,631 | 9/1987 | Haddy | 425/427 |
| 4,957,424 | 9/1990 | Mitchell et al. | 425/424 |
| 5,051,223 | 9/1991 | Kern | 425/425 |
| 5,080,571 | 1/1992 | Crawford | 425/427 |
| 5,147,196 | 9/1992 | Adly | 425/427 |
| 5,364,578 | 11/1994 | Gran | 425/427 |

FOREIGN PATENT DOCUMENTS

| | | |
|---|---|---|
| 0015469 | 5/1982 | European Pat. Off. . |
| 2738944 | 3/1979 | Germany . |
| 3807511C2 | 8/1988 | Germany . |

OTHER PUBLICATIONS

Bertonwerk + Fertigteil–Technik, 1985, vol. 9, pp. 592–593.

*Primary Examiner*—Khanh P. Nguyen
*Attorney, Agent, or Firm*—Darby & Darby

[57] ABSTRACT

A compaction head of a production machine for reinforced concrete pipes has a smoothing cylinder, non-rotatably mounted on its drive shaft, for smoothing the inside of the concrete mixture that has been filled into a vertical mold. On a covering wall of the smoothing cylinder, the rolls, for the radial compaction of a concrete mixture, are mounted axis-parallel and orbiting on a circular path around and driven by the drive shaft at a specified orbiting speed about the axis of the drive shaft and about their own axis, such that the direction of rotation of each of the rolls about its own axis is opposite to that of the covering wall also driven by the drive shaft. To prevent the concrete from being pushed along in front of the rolls during the compaction, and to assure that the concrete is compacted, without thrust, outward in the radial direction, so that the steel wires of the reinforcing cage are completely covered by concrete and that no stresses occur between the cage and the concrete, with corresponding cracks in the interior of the concrete, provision is made that the covering wall of the smoothing cylinder is mounted separately on the drive shaft so that it can rotate relative to the latter, and the rolls are driven by the drive shaft via a transmission, whose transmission ratio is chosen so that the circumferential speed of the rolls is at least the same as their orbiting speed.

4 Claims, 1 Drawing Sheet

COMPACTION HEAD OF A PRODUCTION MACHINE FOR REINFORCED CONCRETE PIPES

This is a continuation of application Ser. No. 08/454,633, filed May. 31, 1995 now abandoned.

BACKGROUND OF THE INVENTION

The invention relates to a compaction head of a production machine for reinforced concrete pipes, comprising a smoothing cylinder non-rotatably mounted on a drive shaft, for smoothing the inside of a concrete mixture that has been filled into a vertical mold, and a covering wall of the smoothing cylinder, the covering wall being mounted separately from the smoothing cylinder and being connected to it by means of a drive mechanism, and on which the rolls for the radial compaction of the concrete mixture are mounted rotatably with respect to the covering wall and axis-parallel with respect to the drive shaft and, together with the covering wall, can be driven at a specified orbiting speed about the axis of the drive shaft, such that the direction of rotation of the rolls about their own axis is opposite to that of the covering wall about the axis of the drive shaft.

With a known compaction head of this type (DE 27 38 944 A1), the rolls which effect the compaction are put into rotational motion only by rolling off, like drag rolls, with the rotation of the covering wall of the smoothing cylinder of the concrete, but without being driven directly. The rolls thus push the fresh concrete in front of them like a bow wave, so that the compaction of the concrete is not free of torsion, and is stronger at the rear side, as viewed in the direction of motion, of the steel wires of the reinforcing cage than on the front side of the steel wires. The consequence of this is cracks in the finished concrete pipe.

OBJECTS OF THE INVENTION

It is the object of the invention to specify a compaction head of this generic type, which assures torsion-free compaction of the concrete during the production of a concrete pipe.

According to the invention, this object is achieved in such a way that the covering wall of the smoothing cylinder is mounted on the drive shaft of the latter, so that it can rotate relative to it, and the rolls are driven to rotate about their own axis by being connected to the drive shaft via a transmission, whose transmission ratio is chosen so that the circumferential speed of the rolls is essentially the same as their orbiting speed.

With this design, the concrete is not pushed ahead in front of the rolls, but is compacted in the circumferential direction of the pipe, without thrust, outward in the radial direction. Consequently, the steel wires of the reinforcing cage are completely encased, and no stresses arise between the cage and the concrete, so that no cracks can occur in the interior of the concrete.

The transmission preferably is disposed in the interior of the smoothing cylinder. Here it is accommodated in a space-saving way and in addition is almost completely protected against the fresh concrete.

Provision can then be made that the upper front surfaces of the rolls have blades, and the rolls extend axially, with radial play, into recesses in the shape of circular segments, situated at the circumference of a circular disk that is rotatably mounted on the drive shaft, such that their upper front surfaces are flush with the top side of the circular disk and their circumferential surfaces protrude beyond the circumference of the circular disk. The blades of the rolls, and the circular disk which rotates together with the rolls in this fashion, exert a centrifugal force on the fresh concrete which falls from above onto the circular disk and between the blades. The centrifugal force hurls the fresh concrete radially outward against the inside of the mold. This already effects a certain pre-compaction.

BRIEF DESCRIPTION OF THE DRAWING

The invention and its further developments are described in more detail below by way of the drawing.

DESCRIPTION OF PREFERRED EMBODIMENTS

Figure 2:
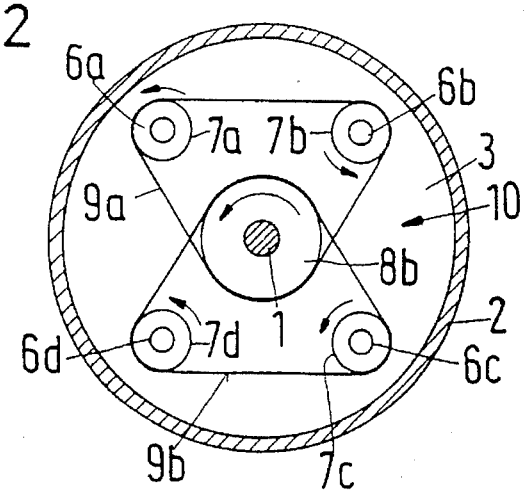
FIG. 2 shows a cross section through the smoothing cylinder, with the transmission disposed therein, as viewed from below.
Figure 1:
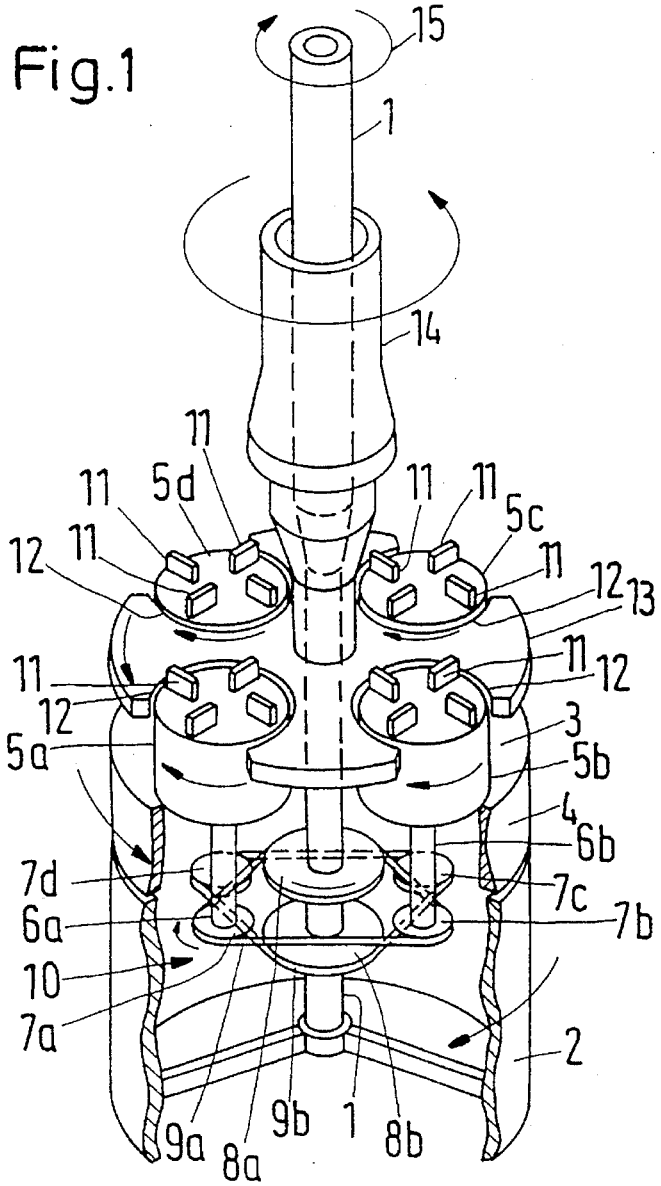
FIG. 1 shows a perspective view of an inventive compaction head, in an exploded and schematic representation.

According to FIG. 1, a smoothing cylinder 2, for smoothing the inside of a concrete mixture filled into a vertical mold (not shown), is mounted on a drive shaft 1 in such a way that it cannot rotate relative to the drive shaft 1. A covering wall 3 is mounted on the drive shaft 1 above the upper front side of the smoothing cylinder 2, in such a way that it can rotate relative to the drive shaft. The covering wall 3 is axially separated from the smoothing cylinder 2, and has a circumferential wall 4 extending axially downward. An axial gap exists between the circumferential wall 4 and the smoothing cylinder 2. Rolls 5*a* to 5*d*, for radially compacting the concrete mixture, are disposed on the covering wall 3, parallel to the axis of the drive shaft 1, in such a way that they can rotate. The rolls 5*a* to 5*d* are respectively seated on shafts 6*a* to 6*d*, in such a way that they cannot rotate with respect to these shafts (see also FIG. 2). The shafts 6*a* to 6*d* rotatably penetrate the covering wall 3. A chain wheel 7*a* to 7*d* is non-rotatably mounted on each respective shaft 6*a* to 6*d*. The shafts 6*c* and 6*d* cannot be seen in FIG. 1, because they are covered by the shafts 6*a* and 6*b*.

A chain wheel 8*a* is mounted non-rotatably on the drive shaft 1 at the level of the chain wheels 7*a* and 7*b*. Another chain wheel 8*b* is also mounted non-rotatably on the drive shaft 1 below the chain wheel 8*a*, at the level of the lower-lying chain wheels 7*c* and 7*d*. A chain 9*a*, which engages the teeth of these chain wheels 7*a*, 7*b*, and 8*a*, runs around the upper chain wheels 7*a*, 7*b*, and 8*a*0. Another chain 9*b*, which engages the teeth of the chain wheels 7*c*, 7*d*, and 8*b*, runs around the chain wheels 7*c*, 7*d*, and 8*b*. The chain wheels 7*a* to 7*d*, the chain wheels 8*a*, 8*b*, and the chains 9*a*, 9*b* together form the transmission 10, through which the rolls 5*a* to 5*d* are connected, in the manner of a drive, to the drive shaft 1. The transmission 10 is disposed in the interior of the smoothing cylinder 2 in space-saving fashion. It is largely protected against contamination by the concrete through the cylinder 2, the covering wall 3, and the circumferential wall 4.

The upper front surfaces of the rolls 5*a* to 5*d* have blades 11 protruding radially and axially. The rolls 5*a* to 5*d*, extend axially, with radial play, into the recesses 12, which are shaped like circular segments and which are situated at the circumference of a circular disk 13, which is rotatably mounted on the drive shaft 1, such that the front surfaces of the rolls 5*a* to 5*d* are flush with the top side of the circular disk 13, and the circumferential surfaces of the rolls protrude somewhat radially outward beyond the circumference of the circular disk 13. The circumference of the circumcircle of all the rolls 5*a* to 5*d* is about the same as that of the smoothing cylinder 2.

The circular disk 13, like the covering wall 3, is non-rotatably mounted on another hollow shaft 14. The latter is coaxially and rotatably mounted on the drive shaft 1. The shafts 1 and 14 are driven in opposite directions by a drive, which is not shown here, via a reversing gear, which also is not shown here, and which is disposed outside or inside the smoothing cylinder 2, or it is driven by its own separate drive. The transmission ratio of the transmission 10 is chosen so that the circumferential speed of each of the rolls 5*a* to 5*d* about its own axis preferably is at least the same as its orbiting speed about the axis of the drive shaft 1. The circumferential speed can also be up to 20% higher or up to 5% lower than the orbiting speed.

When the drive shaft 1 is turned in the direction of the arrow 15, all the remaining parts turn in the direction of the directional arrows drawn in the Figures. At the same time, the entire compaction head is moved axially and upward in the mold, while at the same time the smoothing cylinder 2, which axially trails the rolls 5*a* to 5*d*, takes over the process of closing the pores of the inner pipe surface by smoothing. Since the rolls 5*a* to 5*d* are driven rigidly by the drive shaft 1 via the transmission 10, and are not merely turned by rolling off the inside of the concrete pipe during the compaction, the fresh concrete is not pushed along in front of the rolls 5*a* to 5*d* during the compaction, but is compacted without circumferential thrust, outward in the radial direction. The steel wires of the reinforcing cage are thus completely enclosed. No stresses arise between the cage and the concrete, so that no cracks occur in the interior of the concrete.

A belt transmission, e.g. a toothed belt transmission, or a toothed wheel transmission, can also be used instead of the chain transmission 10. The circumferential wall 4 can be axially shorter than shown or can be omitted entirely. The covering wall 3, with or without the circumferential wall 4, can be mounted inside the upper end of the smoothing cylinder 2 with a radial gap.

What is claimed is:

1. A compaction head of a production machine for reinforced concrete pipes, said compaction head comprising:

a drive shaft having an axis;

a smoothing cylinder non-rotatably mounted on said drive shaft, said smoothing cylinder having means for smoothing the inside of a concrete mixture that has been filled into a vertical mold;

a covering wall being mounted separately from the smoothing cylinder and being connected to the smoothing cylinder by a drive mechanism; and a plurality of rolls, for the radial compaction of the concrete mixture, being rotatably mounted on said drive mechanism with respect to the covering wall and each of said plurality of rolls having an axis that is substantially parallel to the axis of the drive shaft, said plurality of rolls together with said covering wall being driven at a predetermined orbital speed about the axis of said drive shaft, and the rotation of each of said rolls about its own axis being such that the direction of rotation of each of said rolls about its own axis is opposite to the direction of rotation of the covering wall about the axis of the drive shaft, said covering wall being mounted on said drive shaft so that the covering wall rotates relative to the smoothing cylinder, each of the plurality of rolls being driven to rotate about its own axis by being connected to said drive shaft via a transmission, which has a transmission ratio such that the circumferential speed of each of said rolls about its own axis is substantially the same as its orbital speed.

2. The compaction head according to claim 1, wherein the transmission is disposed in the interior of the smoothing cylinder.

3. The compaction head according to claim 1, wherein each of the plurality of rolls has an upper front surface having a plurality of blades disposed thereon, each of the plurality of rolls extends axially, with radial play, into a respective circular shaped recess disposed at the circumference of a circular disk that is rotatably mounted on the drive shaft, the upper front surface of each of said plurality of rolls is disposed flush with a top side surface of the circular disk, and a circumferential surface of each of said plurality of rolls protrudes beyond a circumference of the circular disk.

4. The compaction head according to claim 2, wherein each of the plurality of rolls has an upper front surface having a plurality of blades disposed thereon, each of the plurality of rolls extends axially, with radial play, into a respective circular shaped recess disposed at the circumference of a circular disk that is rotatably mounted on said drive shaft, the upper front surface of each of said plurality of rolls is disposed flush with a top side surface of the circular disk, and a circumferential surface of each of the plurality of rolls protrudes beyond a circumference of the circular disk.

* * * * *